US009301655B1

(12) United States Patent
Coleman

(10) Patent No.: US 9,301,655 B1
(45) Date of Patent: Apr. 5, 2016

(54) HANDS FREE WASHING ASSEMBLY

(71) Applicant: Curtis Coleman, Passaic, NJ (US)

(72) Inventor: Curtis Coleman, Passaic, NJ (US)

( * ) Notice: Subject to any disclaimer, the term of this patent is extended or adjusted under 35 U.S.C. 154(b) by 79 days.

(21) Appl. No.: 14/142,990

(22) Filed: Dec. 30, 2013

(51) Int. Cl.
*A47K 3/022* (2006.01)
*A47K 7/02* (2006.01)

(52) U.S. Cl.
CPC ..... *A47K 7/024* (2013.01); *A61H 2205/081* (2013.01)

(58) Field of Classification Search
CPC ..... A61H 2205/081; A46B 9/005
USPC ..... 4/606; 15/104.92, 160, 210.1, 244.1, 15/244.3
See application file for complete search history.

(56) References Cited

U.S. PATENT DOCUMENTS 2,825,083 A * 3/1958 Sweeting ..... 15/210.1
3,055,037 A * 9/1962 Fjelstad ..... 15/210.1
3,289,215 A * 12/1966 Kennedy ..... 4/606
4,696,068 A * 9/1987 Kenner ..... 4/606
4,759,091 A * 7/1988 Kiss ..... 15/105
4,945,598 A * 8/1990 Racioppi ..... 15/160
5,179,755 A * 1/1993 Hill, Jr. ..... 15/160
5,311,635 A * 5/1994 Moore ..... 15/244.3
5,312,666 A * 5/1994 Jovanovic ..... 428/76
5,628,083 A * 5/1997 Hayes ..... 15/244.3
5,774,907 A 7/1998 Doggwiler
5,822,824 A * 10/1998 Dion ..... 15/210.1
6,370,722 B1 * 4/2002 Duckworth ..... 15/104.92
6,647,564 B1 * 11/2003 Smith ..... 4/606
6,662,386 B1 12/2003 Bowerman
7,467,438 B2 * 12/2008 Ryman ..... 15/244.3
7,472,449 B2 * 1/2009 Orban ..... 15/210.1
7,578,021 B1 * 8/2009 Figueroa ..... 15/104.92
8,191,196 B2 * 6/2012 Aguilar et al. ..... 15/210.1

* cited by examiner

*Primary Examiner* — Lauren Crane
*Assistant Examiner* — Erin Deery

(57) ABSTRACT

A hands free washing assembly for washing a user's back includes a primary frame that may be coupled to a support surface. A coupler is coupled to the primary frame. The coupler engages the support surface so the primary frame is retained on the support surface. A plate is selectively operationally coupled to the primary frame. A user rubs the user's back on the plate so the plate scrubs the user's back. A secondary frame is operationally coupled to the primary frame. The secondary frame retains the plate on the primary frame.

13 Claims, 6 Drawing Sheets

HANDS FREE WASHING ASSEMBLY

BACKGROUND OF THE DISCLOSURE

Field of the Disclosure

The disclosure relates to hands free washing devices and more particularly pertains to a new hands free washing device for washing a user's back.

SUMMARY OF THE DISCLOSURE

An embodiment of the disclosure meets the needs presented above by generally comprising a primary frame that may be coupled to a support surface. A coupler is coupled to the primary frame. The coupler engages the support surface so the primary frame is retained on the support surface. A plate is selectively operationally coupled to the primary frame. A user rubs the user's back on the plate so the plate scrubs the user's back. A secondary frame is operationally coupled to the primary frame. The secondary frame retains the plate on the primary frame.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
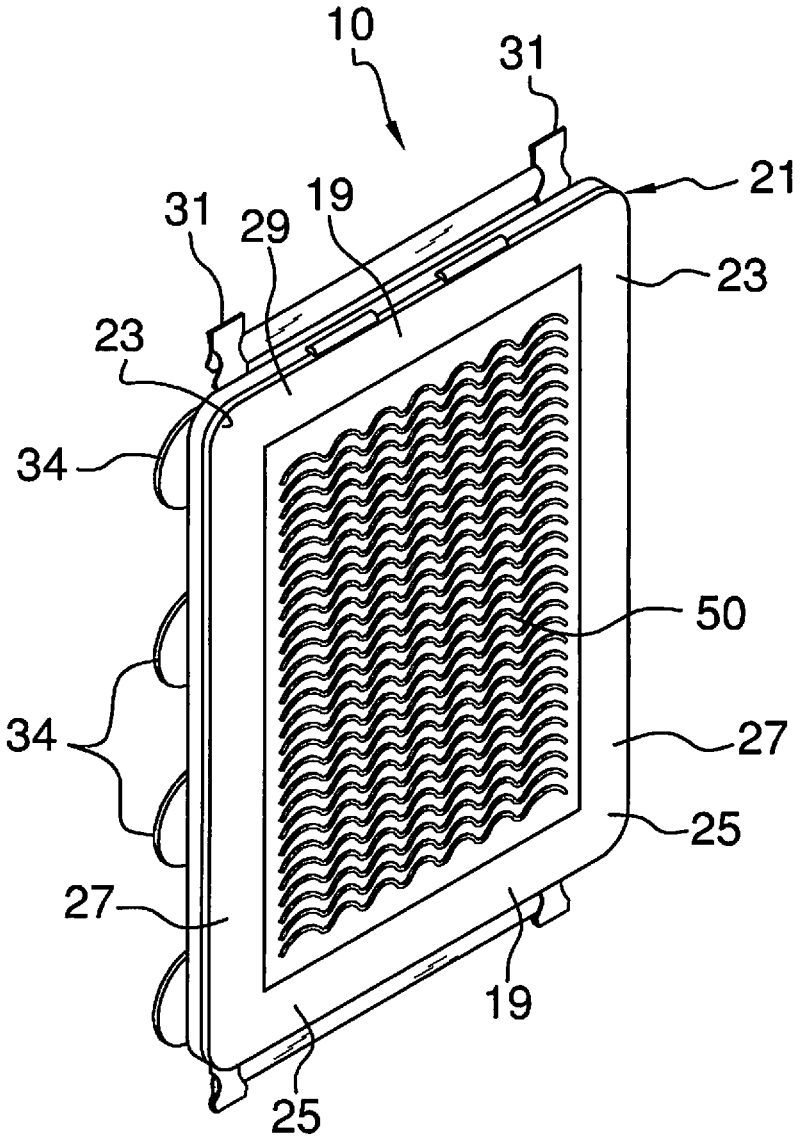
FIG. 1 is a perspective view of a hands free washing assembly according to an embodiment of the disclosure.
Figure 2:
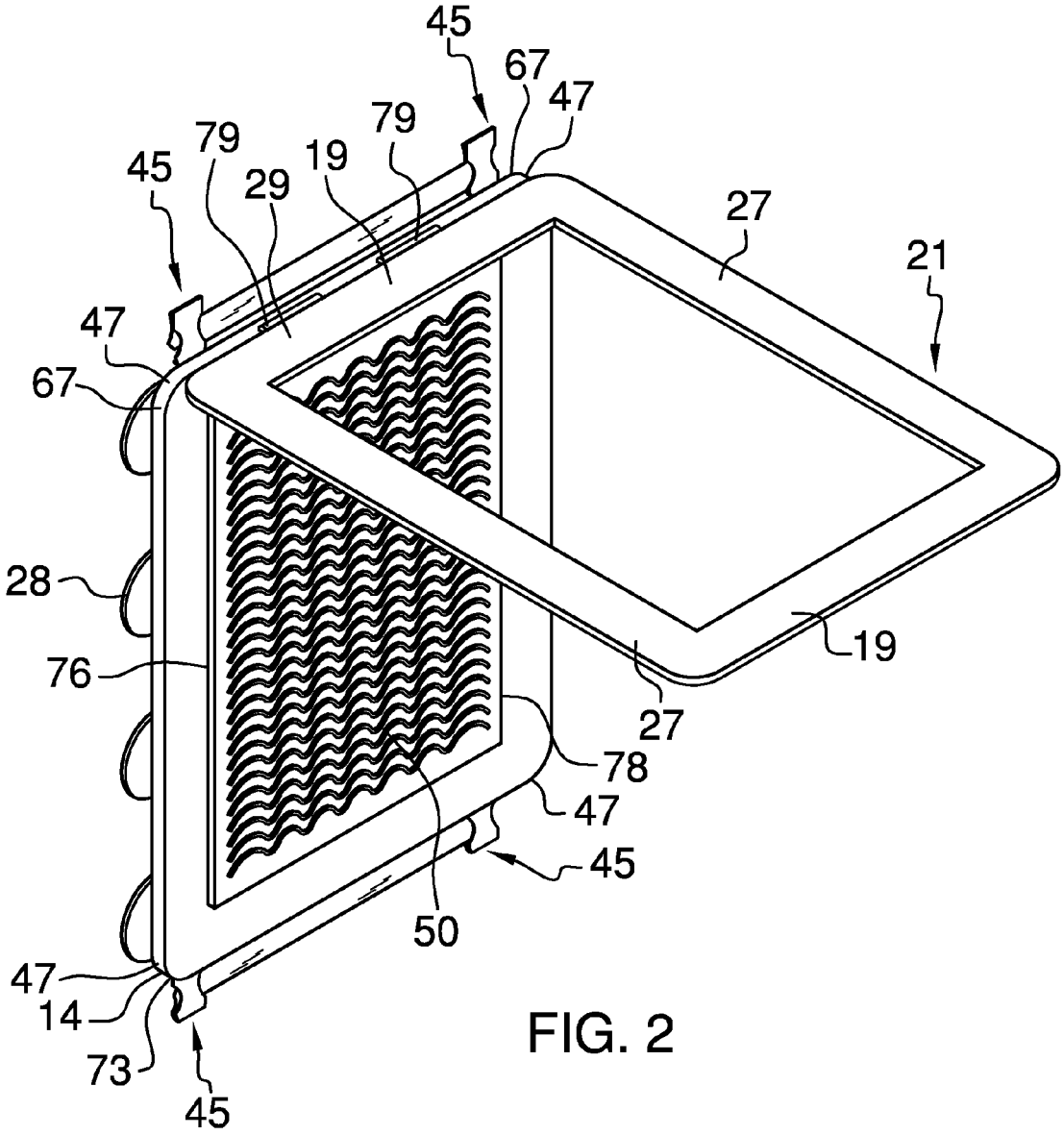
FIG. 2 is a front perspective view of an embodiment of the disclosure.
Figure 3:
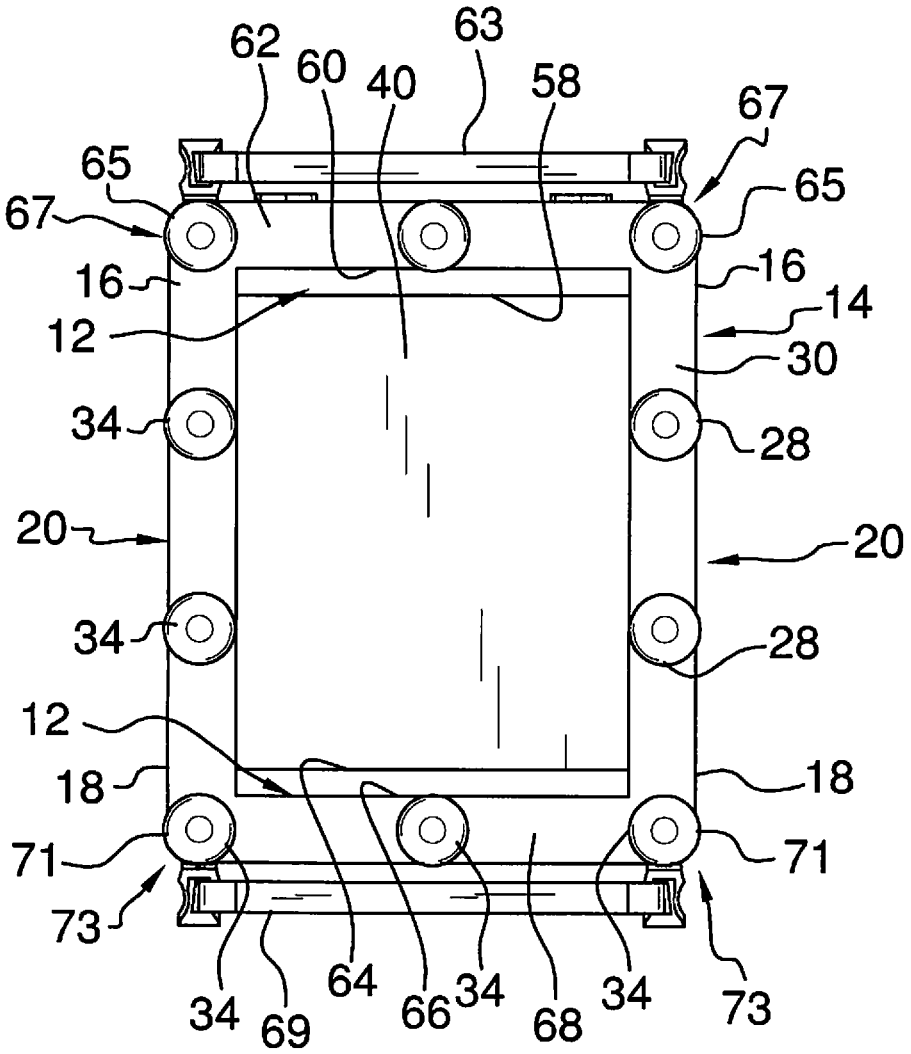
FIG. 3 is a back view of an embodiment of the disclosure.
Figure 4:
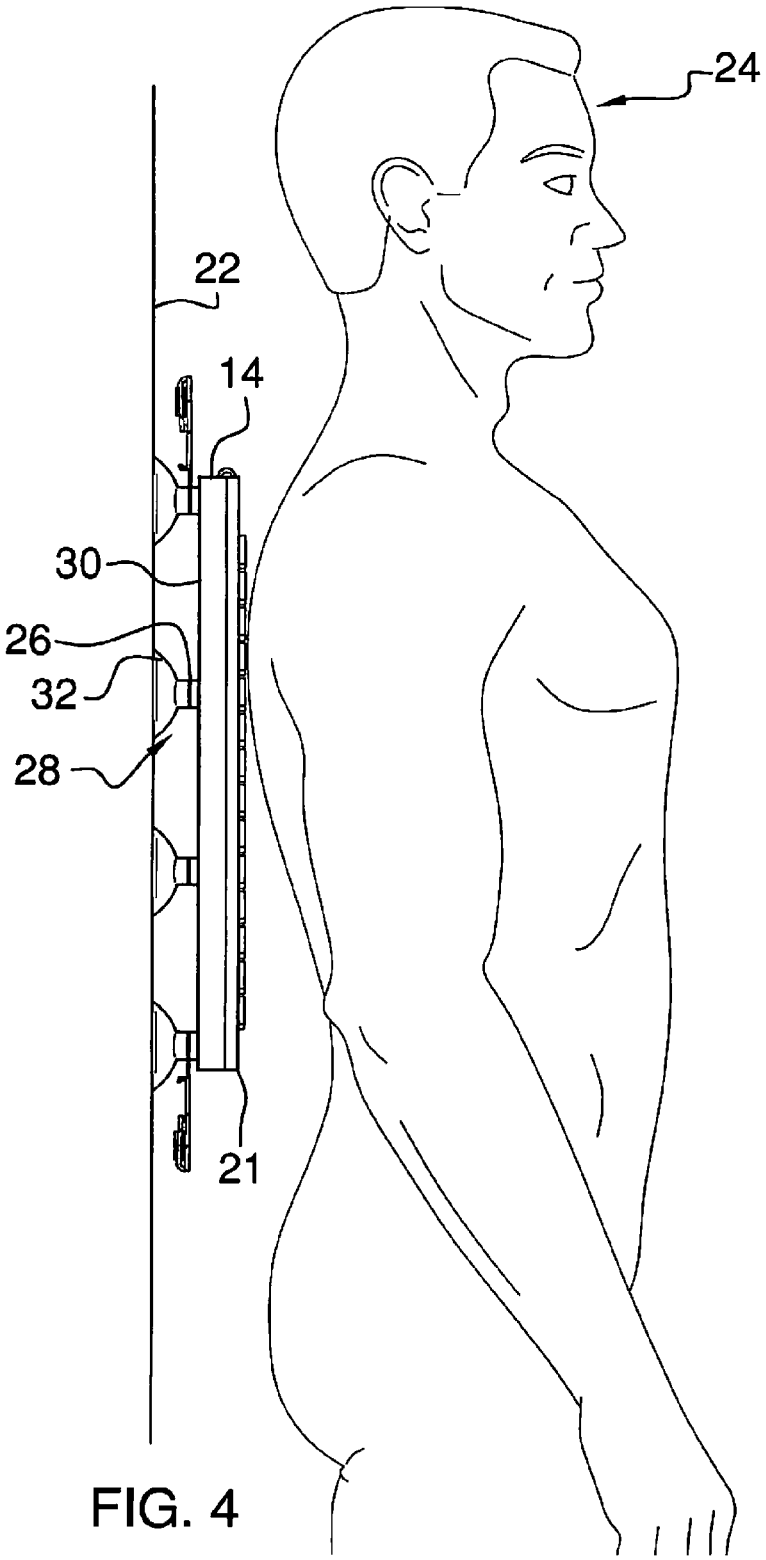
FIG. 4 is a right side view of an embodiment of the disclosure.
Figure 5:
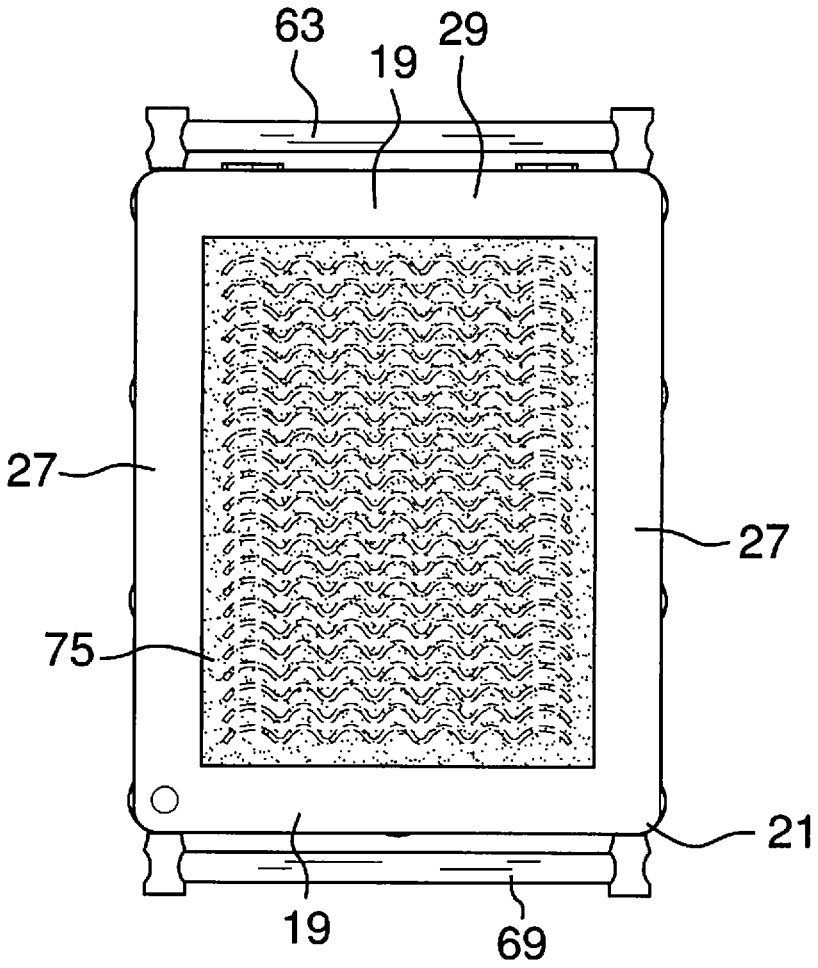
FIG. 5 is a front view of an embodiment of the disclosure.
Figure 6:
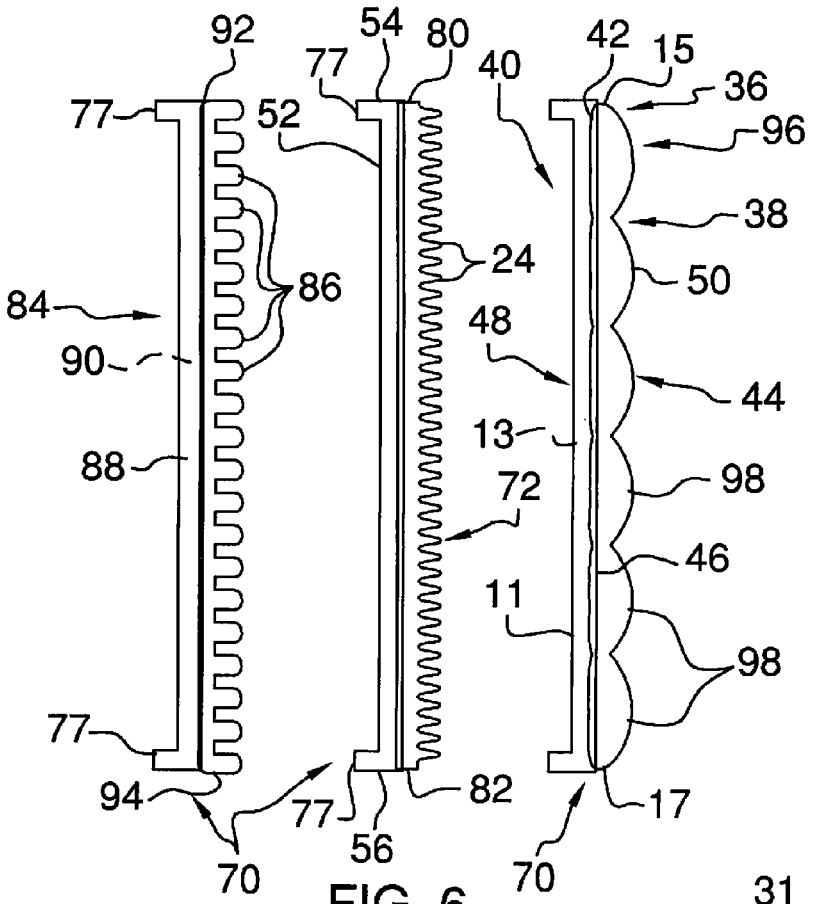
FIG. 6 is a right side perspective view of an embodiment of the disclosure.
Figure 7:
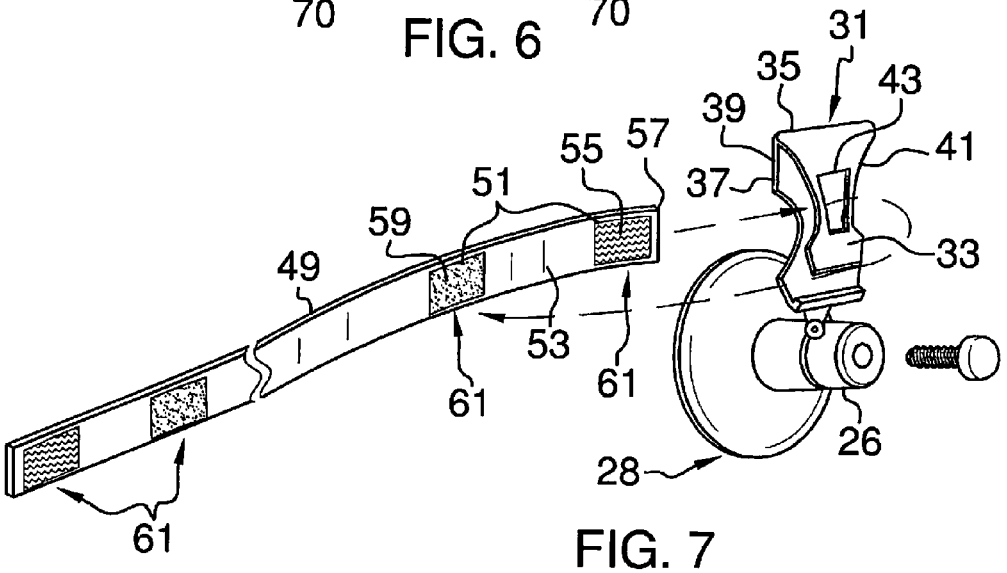
FIG. 7 is a left side perspective view of an embodiment of the disclosure.

With reference now to the drawings, and in particular to FIGS. 1 through 7 thereof, a new hands free washing device embodying the principles and concepts of an embodiment of the disclosure and generally designated by the reference numeral 10 will be described.

As best illustrated in FIGS. 1 through 7, the hands free washing assembly 10 generally comprises a pair of lateral arms 12 of a primary frame 14 each coupled between an associated top end 16 and a bottom end 18 of each of a pair of vertical arms 20 of the primary frame 14. The primary frame

14 has a rectangular shape that may have a width between 20 cm and 25 cm and a height between 25 cm and 30 cm. Moreover, the primary frame 14 may be coupled to a support surface 22. The support surface 22 may be a wall in a shower or other location that a user 24 will occupy for bathing purposes.

A cylindrical portion 26 of a coupler 28 is coupled to a back side 30 of the primary frame 14. A conical portion 32 of the coupler 28 extends forwardly from the cylindrical portion 26 of the coupler 28. The conical portion 32 of the coupler 28 engages the support surface 22 so the primary frame 14 is retained on the support surface 22. Moreover, the coupler 28 may be a suction cup of any conventional design. The coupler 28 is one of a plurality of the couplers 34. Lastly, the plurality of couplers 34 is evenly distributed around an entire perimeter of the primary frame 14.

A plate 36 is provided. Moreover, the plate 36 has a width that is less than a length of the plate 36. The plate 36 has a rectangular cross section taken along a longitudinal axis extending through a front side 38 and a back side 40 of the plate 36. Moreover, the plate 36 may have a width between 15 cm and 20 cm and a height between 20 cm and 25 cm.

A rear side 42 of a scrubbing portion 44 of the plate 36 is coextensively coupled to a front side 46 of an engaging portion 48 of the plate 36. A front side 50 of the scrubbing portion 44 of the plate 36 is textured. The scrubbing portion 44 of the plate 36 may be comprised of a resiliently compressible material such as rubber or other similar material. The plate 36 is selectively operationally coupled to the primary frame 14. The user 24 rubs the user's back on the front side 46 of the scrubbing portion 44 of the plate 36 so the plate 36 scrubs the user's back.

A pair of tabs 77 is coupled to and extends rearwardly away from a rear side 52 of the engaging portion 48 of the plate 36. The pair of tabs 77 are each positioned proximate an associated one of a top side 54 and a bottom side 56 of the engaging portion 48 of the plate 36. Each of the pair of tabs 77 engages the primary frame 14 so the plate 36 is retained in the primary frame 14. A top one of the pair of tabs 58 abuts a bottom side 60 of a top one of the pair of lateral arms 62 of the primary frame 14. Additionally, a bottom one of the pair of tabs 64 abuts a top side 66 of a bottom one of the pair of lateral arms 68 of the primary frame 14. The plate 36 is one of a plurality of the plates 70.

The front side 50 of the scrubbing portion 44 of each of the plurality of plates 70 has a differing texture. Continuing, the front side 50 of the scrubbing portion 44 of a first one of the plurality of plates 72 comprises a plurality of raised, undulating ribs 74 extending between a first lateral side 76 and a second lateral side 78 of the scrubbing portion 44 of the first plate 72. Additionally, the plurality of raised, undulating ribs 74 is evenly distributed between a top end 80 and a bottom end 82 of the scrubbing portion 44 of the first plate 72.

The front side 50 of the scrubbing portion 44 of a second one of the plurality of plates 84 comprises a plurality of raised, laterally coextensive ribs 86 extending between a first lateral side 88 and a second lateral side 90 of the scrubbing portion 44 of the second plate 84. Further, the plurality of raised, laterally coextensive ribs 86 is evenly distributed between a top end 92 and a bottom end 94 of the scrubbing portion 44 of the second plate 84. Continuing, the front side 50 of the scrubbing portion 44 of a third one of the plurality of plates 96 comprises a plurality of raised, semi-cylindrical ribs 98 extending between a first lateral side 11 and a second lateral side 13 of the scrubbing portion 44 of the third plate 96. Lastly, the plurality of raised, semi-cylindrical ribs 98 is evenly distributed between a top end 15 and a bottom end 17 of the scrubbing portion 44 of the third plate 96.

A pair of lateral arms 19 of a secondary frame 21 is each coupled between an associated top 23 and bottom 25 end of each of a pair of vertical arms 27 of the secondary frame 21. The secondary frame 21 has a rectangular shape that may have a width between 15 cm and 20 cm and a height between 20 cm and 25 cm. A top one of the pair of lateral arms 29 of the secondary frame 21 is hingedly coupled to the top lateral arm 62 of the primary frame 14 by hinges 79. The secondary frame 21 is positionable in an open position so the secondary frame 21 extends forwardly from the top lateral arm 62 of the primary frame 14. Additionally, the secondary frame 21 is positionable in a closed position so the secondary frame 21 coextensively abuts the primary frame 14.

A clip 31 is removably coupled to the cylindrical portion 26 of the coupler 28. A front portion 33 of the clip 31 extends downwardly from a top end 35 of a rear portion 37 of the clip 31. Further, the clip 31 has a U-shaped cross section taken along a lateral axis extending between a first lateral edge 39 and a second lateral edge 41 of the clip. A strap aperture 43 extends through the front portion 33 of the clip 31. The clip 31 is one of a plurality of the clips 45. Each of the plurality of clips 45 is removably coupled to an associated one of the plurality of couplers 34 that are each positioned proximate an associated one of four corners 47 of the primary frame 14.

A strap 49 is provided. The strap 49 may be comprised of a resiliently stretchable material such as elastic or other similar material. Continuing, a pair of couplers 51 is coupled to a front side 53 of the strap 49. A first one of the pair of couplers 55 is positioned proximate an end 57 of the strap 49. Moreover, a second one of the pair of couplers 59 is spaced apart from the first coupler 55. Lastly, the pair of couplers 51 are each one of a pair of sets of the pair of couplers 61.

The end 57 of the strap 49 is positionable in the clip 31 so the end 57 of the strap 49 extends through the strap aperture 43. Continuing, the first 55 and second 59 couplers are complimentary so the strap 49 is retained on the clip 31. The first 55 and second 59 couplers may comprise hook and loop fasteners of any conventional design. Lastly, the strap 49 is one of a pair of the straps 49. A first one of the pair of straps 63 is selectively positionable between a top set of the plurality of couplers 65 each positioned proximate an associated one of a top pair of corners 67 of the primary frame 14. A second one of the pair of straps 69 is selectively positionable between a bottom set of the plurality of couplers 71 each positioned proximate an associated one of a bottom pair of corners 73 of the primary frame 14.

In use, the primary frame 14 is coupled to the support surface 22 at a point that is accessible to the user 24. A selected one of the plurality of plates 70 is positioned within the primary frame 14. Continuing, a washcloth 75 is positioned over the front side 50 of the scrubbing portion 44 of the plate 36. The secondary frame 21 is positioned in the closed position so the washcloth 75 is retained on the plate 36. Lastly, the user 24 rubs the user's back on the washcloth 75 so the user's back is washed.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A hands free washing assembly for washing a user's back, said assembly comprising:

a primary frame configured to be coupled to a support surface;

a coupler coupled to said primary frame, said coupler engaging the support surface wherein said primary frame is retained on the support surface;

a plate selectively operationally coupled to said primary frame wherein a user rubs the user's back on said plate wherein said plate scrubs the users back;

a secondary frame operationally coupled to said primary frame wherein said secondary frame retains said plate on said primary frame;

a pair of tabs, said tabs being coupled to and extending rearwardly away from a rear side of an engaging portion of said plate, one tab proximate to a top side of said engaging portion of said plate and the other tab proximate to a bottom side of said engaging portion of said plate;

a top one of a pair of lateral arms of said secondary frame being hingedly coupled to a top one of a pair of lateral arms of said primary frame;

and a clip removably coupled to said coupler.

2. The assembly according to claim 1 wherein the primary frame pair of lateral arms are each coupled between an associated top and bottom end of each of a pair of vertical arms of said primary frame, and wherein said primary frame has a rectangular shape.

3. The assembly according to claim 1 further comprising said coupler being coupled to a back side of said primary frame.

4. The assembly according to claim 1 further comprising said coupler being one of a plurality of said couplers.

5. The assembly according to claim 4 further comprising said plurality of couplers being evenly distributed around an entire perimeter of said primary frame.

6. The assembly according to claim 1 further comprising said plate having a width being less than a length of said plate.

7. The assembly according to claim 1 further comprising a rear side of a scrubbing portion of said plate being coextensively coupled to a front side of an engaging portion of said plate.

8. The assembly according to claim 1 further comprising wherein said pair of tabs extends between a first lateral side and a second lateral side of said engaging portion of said plate.

9. The assembly according to claim 1 further comprising a front side of a scrubbing portion of said plate being textured.

10. The assembly according to claim 1 further comprising said secondary frame comprising a pair of lateral arms of said secondary frame each coupled between an associated top and bottom end of each of a pair of vertical arms of said secondary frame wherein said secondary frame has a rectangular shape.

11. The assembly according to claim 1 further comprising said clip being one of a plurality of said clips.

12. The assembly according to claim 11 further comprising each of said plurality of clips being removably coupled to an associated one of a plurality of couplers each positioned proximate an associated one of four corners of said primary frame.

13. A hands free washing assembly for washing a user's back, said assembly comprising:

a pair of lateral arms of a primary frame each coupled between an associated top and bottom end of each of a pair of vertical arms of said primary frame wherein said primary frame has a rectangular shape, said primary frame being configured to be coupled to a support surface;

a coupler coupled to a back side of said primary frame, said coupler engaging the support surface wherein said primary frame is retained on the support surface, said coupler being one of a plurality of said couplers;

said plurality of couplers being evenly distributed around an entire perimeter of said primary frame;

a plate having a width being less than a length of said plate, a rear side of a scrubbing portion of said plate being coextensively coupled to a front side of an engaging portion of said plate, a front side of said scrubbing portion of said plate being textured, said plate being selectively operationally coupled to said primary frame wherein a user rubs the user's back on said front side of said scrubbing portion of said plate wherein said plate scrubs the user's back;

a pair of tabs, said tabs being coupled to and extending rearwardly away from a rear side of an engaging portion of said plate, one tab proximate to a top side of said engaging portion of said plate and the other tab proximate to a bottom side of said engaging portion of said plate;

a pair of lateral arms of a secondary frame each coupled between an associated top and bottom end of each of a pair of vertical arms of said secondary frame wherein said secondary frame has a rectangular shape, a top one of said pair of lateral arms of said secondary frame being hingedly coupled to a top one of said pair of lateral arms of said primary frame;

a clip removably coupled to said coupler, said clip being one of a plurality of said clips; and each of said plurality of clips being removably coupled to an associated one of said plurality of couplers each being positioned proximate an associated one of four corners of said primary frame.

* * * * *